US005867187A

United States Patent [19]

Toniolo

[11] Patent Number: 5,867,187

[45] Date of Patent: Feb. 2, 1999

[54] INK-JET PRINT HEAD STORAGE APPARATUS

[75] Inventor: Antonio Toniolo, Aglie' , Italy

[73] Assignee: Olivatti-Canon Industriale, S.p.A., Ivrea, Italy

[21] Appl. No.: 574,316

[22] Filed: Dec. 18, 1995

[30] Foreign Application Priority Data

Dec. 22, 1994 [IT] Italy ..... TO94A1056

[51] Int. Cl.[6] ..... B41J 2/165

[52] U.S. Cl. ..... 347/32; 347/29

[58] Field of Search ..... 347/29, 320

[56] References Cited

U.S. PATENT DOCUMENTS 5,155,497 10/1992 Martin et al. ..... 346/1.1
5,373,936 12/1994 Kawai et al. ..... 347/86
5,585,826 12/1996 Schroeder et al. ..... 347/29

FOREIGN PATENT DOCUMENTS 0560266 9/1993 European Pat. Off. ..... B41J 2/175

OTHER PUBLICATIONS

Japanese Patent Abstract 61/230,946, vol. 11, No. 76, (M–569) [2523] Mar. 7, 1987.

*Primary Examiner*—Jeffrey L. Sterrett
*Attorney, Agent, or Firm*—Banner & Witcoff, Ltd.

[57] ABSTRACT

The storage apparatus permits preservation under optimum conditions of an only partially used, interchangeable ink jet print head, when not in use on the relative printer; it is apt to accommodate both a print head for black printing and one for color printing, in the same way and with the same orientation as provided for their insertion in the printer's print head carriage, in a single cavity. Insertion of the print head in the storage apparatus automatically selects and commands the specific capping system for that type of print head, capable of efficaciously isolating and protecting the nozzles, even for long periods of time.

13 Claims, 5 Drawing Sheets

INK-JET PRINT HEAD STORAGE APPARATUS

BACKGROUND OF THE INVENTION

1. Field of the invention

The present invention refers to a storage apparatus apt to preserve an ink jet printhead of the interchangeable cartridge type, insertable on devices generating images on a medium, after the former has been removed from its packaging and possibly already partially used on the device.

The storage apparatus maintains the area of the said printhead bearing the nozzles for discharging the ink droplets (called ejector plate) substantially sealed inside an environment impregnated with humidity in such a way as to prevent evaporation and coagulation of said ink with consequent occlusion of the nozzles, even if the printhead is not used for prolonged periods of time.

2. Description of the Prior Art

Devices are known in the current art for generation of images on a medium, generally sheets of paper or other suitable material, for example ink jet printers, using interchangeable printheads of the monobloc, disposable cartridge type, i.e. with an ink reservoir integrated within the printhead, or of the "refillable" cartridge type, i.e. with an ink reservoir that can be replaced.

The printheads may contain a black (or generically monochromatic) ink, or three inks of different colours in the reservoir, thus permitting, simply by changing the printhead, printing in black or in colour with the same printer, which provides considerable flexibility and variety of use.

On these types of printer, or more exactly in the printhead carriage thereof, a single printhead at a time may be resident, so that users are faced with the problem of having at least one printhead, sometimes the monochromatic type, at other times the colour type, still partially filled with ink and functioning perfectly, that has to be preserved in a suitable container to avoid it from deteriorating during the periods in which it is not used to the extent that it may become no longer functional or in some way defective.

In fact, the characteristics of the ink and the dimensions of the nozzles from which the ink droplets are ejected during printing are such that, if the printhead is left for even relatively short periods of time with the ejector plate thereof exposed to the surrounding environment, the ink coagulates, thereby occluding the nozzles and the printhead becomes unusable.

The danger thereof is so great that the ink jet printers known in the current art are equipped with what is known as a "service station", one of the declared objects of which is to protect and isolate the nozzles from the surrounding environment whenever the printhead is not functioning, even in the time intervening between printing of one sheet and the next should this interval exceed a given, predetermined time.

Martin et al., in U.S. Pat. No. 5,155,497, describe one of these "service stations", interchangeably adaptable, through the rotation of a support, for protecting a printhead for black printing or alternatively a printhead for colour printing, and which comprises a cap that encloses the ejector plate, isolating it from the external environment in such a way as to prevent coagulation of the ink and contamination of the nozzles by dust.

This eliminates the problem for the printhead remaining on board the printer carriage, but it is evident that, if the user of the printer concurrently has two different types of interchangeable printhead in usage, the problem still remains of preserving that printhead which is momentarily not fitted in the printhead carriage of the printer.

The most frequent case, and the one to which reference shall be made hereinafter in the disclosure of this invention, but which is by no means limiting, is that in which the printer can work interchangeably with a printhead for black printing (the type most commonly used, for example, to print texts) or with a printhead for colour printing (containing three coloured inks and used mainly for graphic printing): when the printer uses the printhead for black printing, the printhead for colour printing must be preserved externally to the printer under proper conditions, and vice versa when the printer uses the printhead for colour printing.

To solve this specific problem, dedicated storage apparatuses have been constructed, such as, for example, that described by Kawai et al. in European Patent Application No. EP 560266, in which a container comprises within a cap similar to that described in the Martin et al. Patent cited above, a cap which comes into contact with the ejector plate of the printhead in such a way as to seal it, and is further connected to a member that is capable of absorbing any ink seeping out of the nozzles, for example following variations in ambient temperature or pressure.

The dimensions of the cap, generally formed of a synthetic rubber with low gas permeability and in particular of EPDM, must be calculated correctly in function of the type of printhead to which the cap will be coupled, this to guarantee the effective sealing properties of the device; usually, the dimensions of the ejector plate on printheads for black printing and of the ejector plate on those for colour printing are different, because of the different number of nozzles and consequently, a cap suitable for a printhead for black printing may not also be fit for use on a printhead for colour printing, and vice versa.

Containers for preserving interchangeable printheads are known in the current art, comprising two distinct and independent cavities, one capable of receiving only a printhead for black printing, and the other capable of receiving only a printhead for colour printing; accordingly however, encumbrance of the container is considerable and users must take care to insert the right printhead in its proper cavity.

SUMMARY OF THE INVENTION

The object of the present invention is to define a storage apparatus for preservation of ink jet printheads, having a single cavity capable of receiving alternatively a printhead for black printing and one for colour printing, in such a way that overall encumbrance is particularly low and is only slightly greater than that of a single printhead.

Another object of the present invention is that of defining a storage apparatus for the preservation of ink jet printheads, having a single cavity capable of receiving alternatively a printhead for black printing and one for colour printing, such as to be considerably simple to use, in such a way that the user does not have to face the problem of recognizing whether the printhead to be preserved is of the type for black printing or for colour printing before inserting therein the printhead to be preserved.

A further object of the present invention is that of defining a storage apparatus for the preservation of ink jet printheads, having a single cavity capable of receiving alternatively a printhead for black printing and one for colour printing, such that the dimensions of the cap for sealing of the ejector plate of the printhead automatically adapt to the type of printhead present in the device in question.

Another object of the present invention is that of defining a storage apparatus for the preservation of ink jet printheads, having a single cavity capable of receiving alternatively a printhead for black printing and one for colour printing, such that a cap of the right dimensions is automatically selected for sealing the ejector plate of the printhead present in the device in question.

Another object of the present invention is that of defining a method for correctly preserving an ink jet printhead, for black printing and for colour printing, apt to be fitted interchangeably in a device for generating images on a medium.

Another object of the present invention is that of defining a device for generating images on a medium using interchangeably an ink jet printhead both for black printing and for colour printing, such that the printhead that is not momentarily being used for printing is correctly preserved on board the said printer, in addition to the one mounted in the printhead carriage.

These objects are attained by means of a device, designed for incorporation inside a printer, and a method for storage of ink jet printheads, according to the characteristics defined in the main claims.

These and other characteristics of the present invention will become evident from the description of a preferred embodiment, provided as a non-restrictive example, with reference to the drawings attached.

DESCRIPTION OF THE PREFERRED EMBODIMENTS

In the description that follows, explicit reference is made to ink jet printhead models for black printing and for colour printing, produced and commercialized by Olivetti to be used, for example, with printer model JP 450, characteristics of which are not therefore described in detail; it remains understood, however, that the creative concepts of this invention may easily be used for storage apparatuses apt to accommodate printheads of different shapes and characteristics from those cited in the foregoing.

Figure 1:
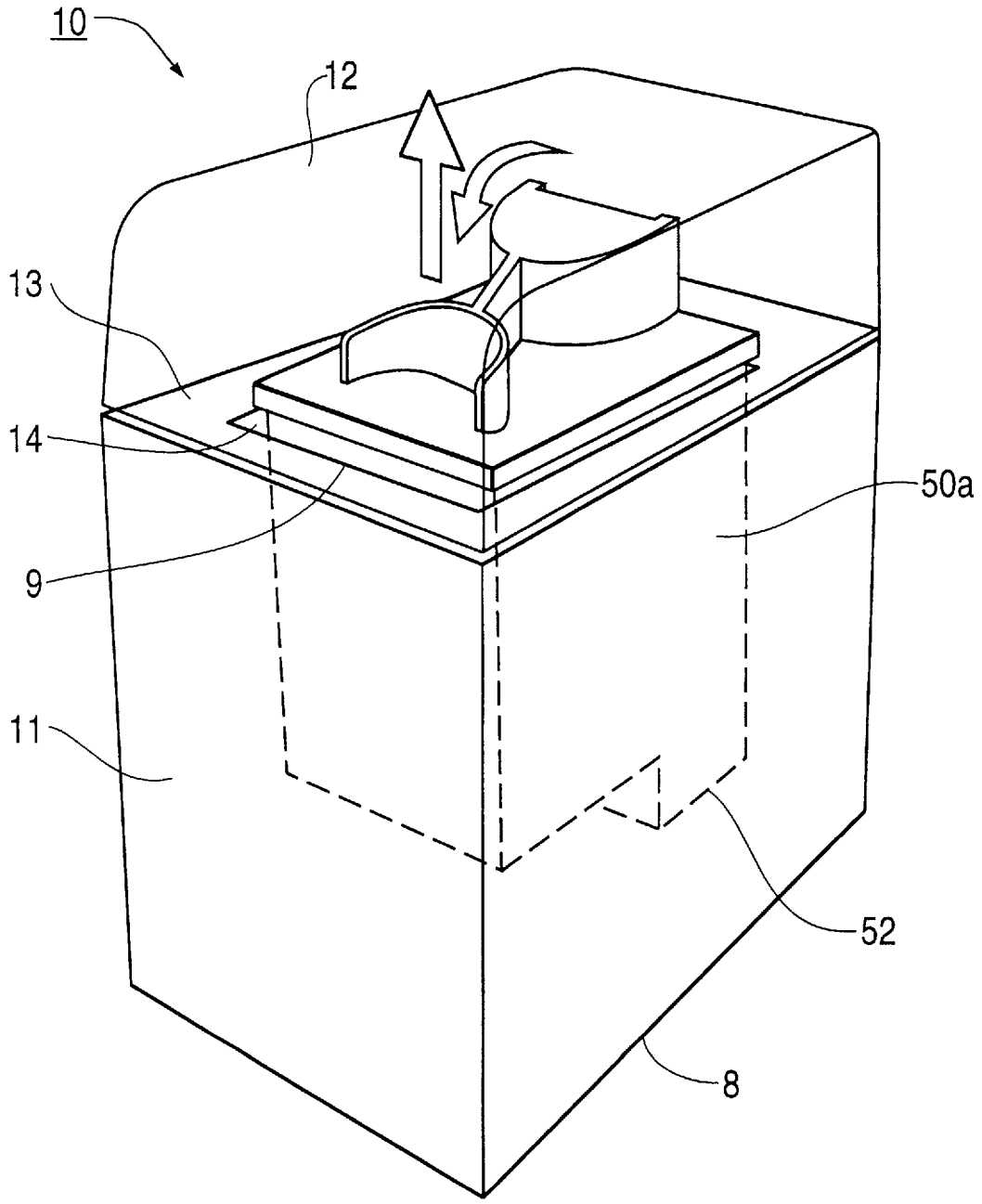
FIG. 1 is an overall view of the storage apparatus according to the present invention.

The storage apparatus comprises a container 10 (FIG. 1) of substantially parallepiped shape, consisting of a base 11, in one top surface 13 of which an aperture 14 has been made, the perimeter 9 of which, duly shaped, serves as a guide and provides the orientation for insertion of a printhead 50*a* (illustrated in overlay), and having a lid 12. The parallepiped shape is obviously not limiting, as the container 10 could also for example be cylindrical in shape.

The printhead 50*a*, whether of the type for black printing 50*b* (FIG. 4) or for colour printing 50*c* (FIG. 3), is inserted in the container 10 with identical orientation for both types, and in exactly the same way as for its insertion in the printhead carriage of a printer, thereby avoiding all problems for the user.

A snap-fit catch (not shown in the figure), similar to the one on the printhead carriage of the printer and known in the art, is used to stably lock the printhead 50*a* inside the container 10, simultaneously providing the user both tactile and audible confirmation that the printhead has been correctly inserted in the storage apparatus.

Figure 2:
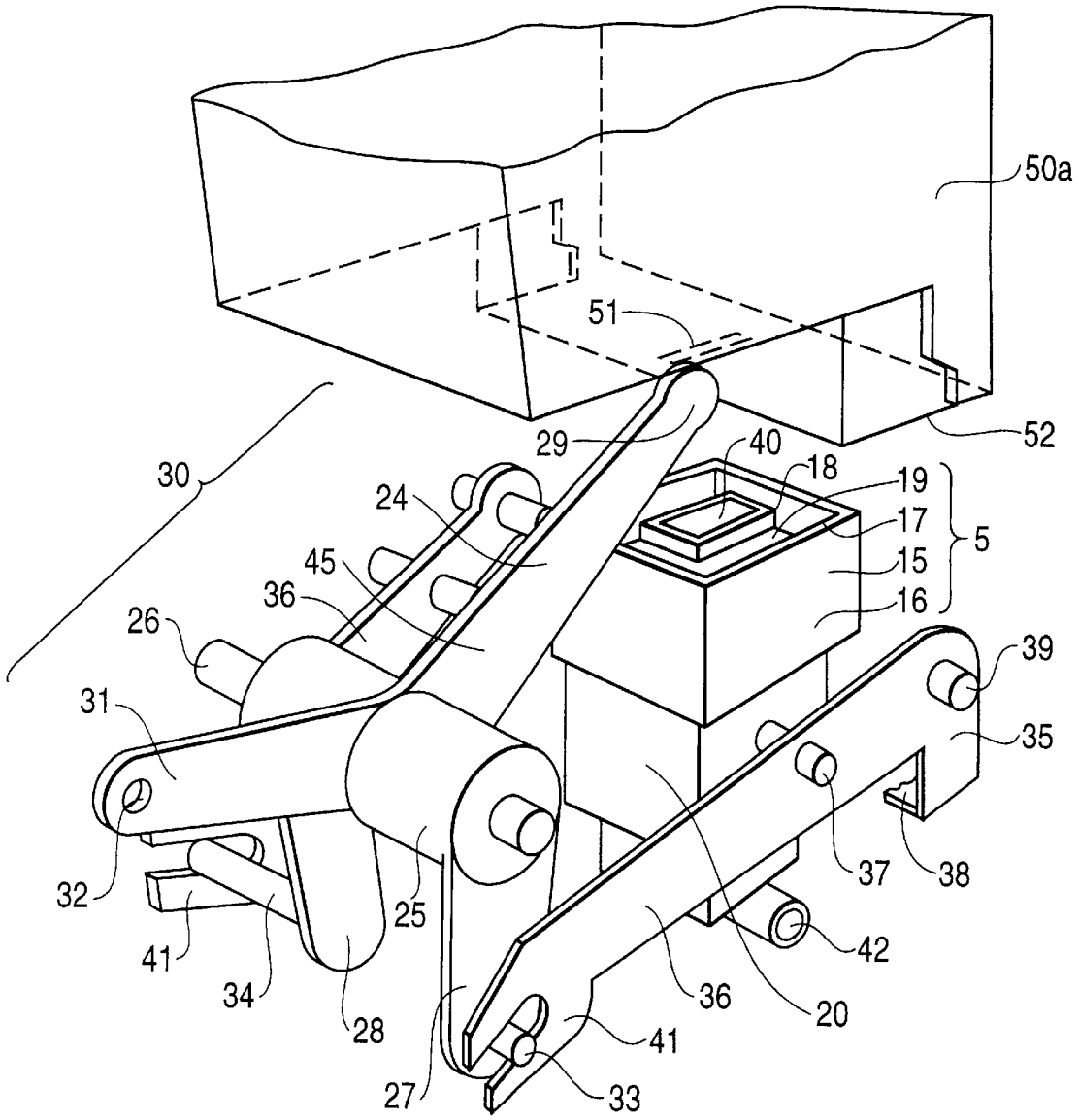
FIG. 2 is a perspective view of the positioning mechanism and of the capping system for sealing of the area of the printhead bearing the nozzles, according to a first, preferred embodiment.

According to a first version of the preferred embodiment of the storage apparatus disclosed in the present invention, inside the base 11 of the container 10 resides a capping system 5 (FIG. 2) that will be described in greater detail in the following, comprising a synthetic rubber cap 15 which is selectively brought into contact by a position mechanism 30 with a support face 52 of the printhead 50*a* bearing the ejector plate containing the nozzles 51 for discharge of the ink, thereby isolating the latter from the external atmosphere. Overall number and disposition of the nozzles 51 varies depending on whether printhead 50*a* is for black type printing 50*b* or for colour printing 50*c*, the main difference between the two types of printhead, for the purposes of the present invention, lying in the dimensions of support face 52, smaller in the case of a printhead for black printing 50*b*, larger in the case of a printhead for colour printing 50*c*.

Rubber cap 15 comprises an outside wall 16 which terminates, confronting the support face 52 of printhead 50*a* at its top portion, in an external elastic rim 17, and an inside wall 19 which terminates, also confronting support face 52 at its top portion, in an internal elastic rim 18.

Both the outside 16 and inside 19 walls are approximately rectangular in shape and are arranged concentrically around a hollow central area 40, bottom portion of which is connected to a flexible pipe 42. The two elastic rims, internal 18 and external 17, define an area which, when projected on to support face 52, surrounds the nozzles 51, respectively of the printhead for black printing 50*b* and of the printhead for colour printing 50*c*.

Figure 3:
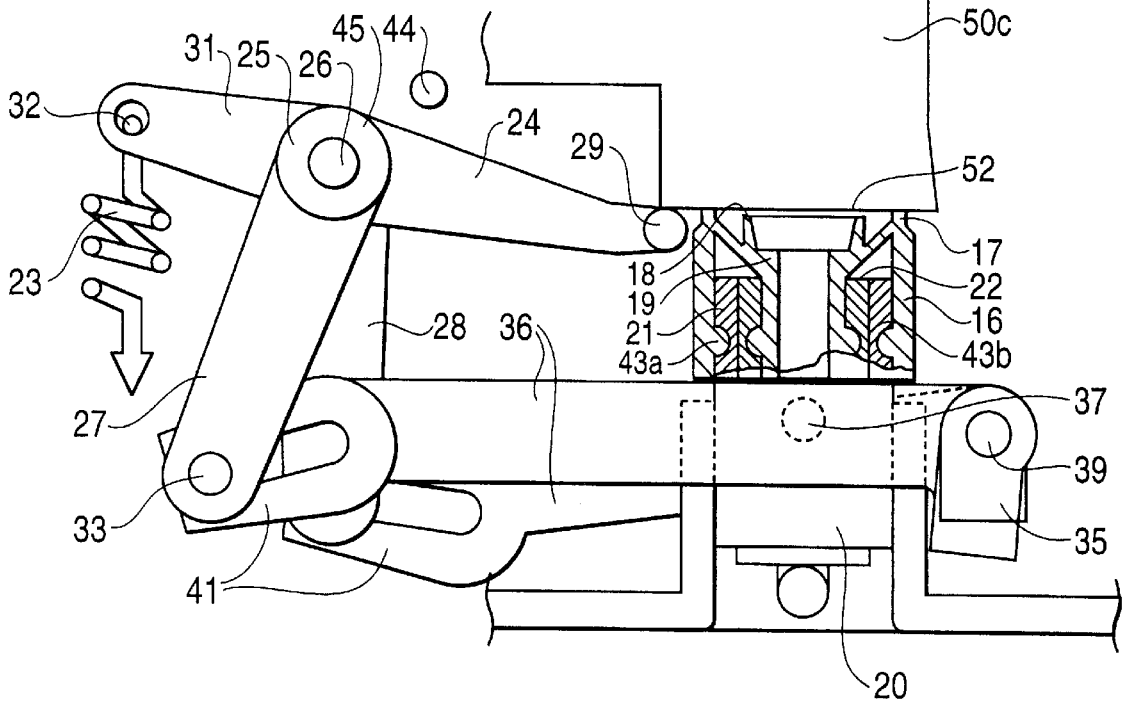
FIG. 3 is a side elevational view of the positioning mechanism and of the capping system for sealing of the area of the printhead bearing the nozzles, according to a first, preferred embodiment, in the event that the storage apparatus contains a printhead for colour printing.

Cap 15 is fitted on a support 20 comprising two concentric members, external member 21 and internal member 22 (FIG. 3), in such a way that the outside wall 16 is in contact with and bound to external member 21 and the inside wall 19 is in contact with and bound to internal member 22; the coupling between wall 16, 19 and member 21, 22 may be made, as in FIG. 3, by fittings formed of protrusions 43*a* and corresponding recesses 43*b*, made by modifying respectively the thicknesses of wails 16, 19 and of sliding members 21, 22, or using other systems, for example gluing, vulcanization, rivetting, etc.

Figure 4:
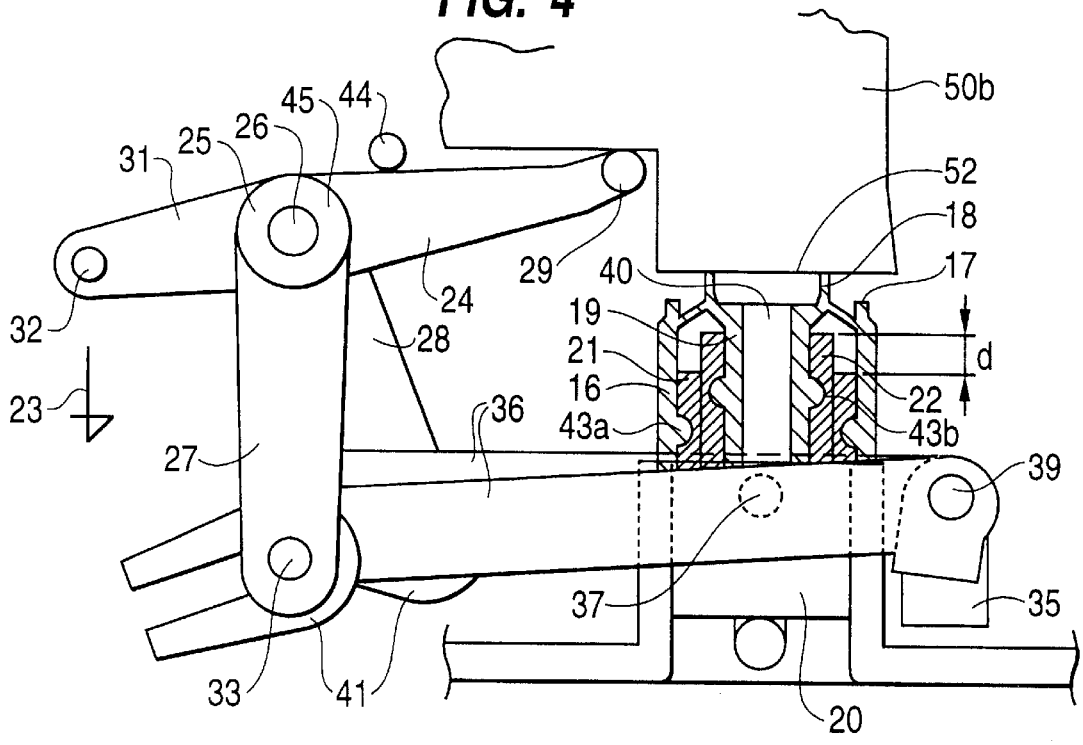
FIG. 4 is a side elevational view of the positioning mechanism and of the capping system for sealing of the area of the printhead bearing the nozzles, according to a first, preferred embodiment, in the event that the storage apparatus contains a printhead for black printing.

The internal 22 and external 21 translating members are capable of translating or reciprocating over a distance of length "d", before assuming two defined positions, shown respectively in FIGS. 3 and 4: the position of FIG. 3 is that assumed when a printhead 50*c* for colour printing is inserted in container 10, whereas the position in FIG. 4 is that assumed when a printhead 50*c* for black printing is inserted in the storage apparatus, or when no printhead is inserted therein.

When there is no printhead inside container 10, support 20 assumes the position of FIG. 4 due to the action of a return spring 23 (shown schematically in the figure as an arrow), which brings a probe arm 24 against a suitably disposed stop 44; when there is a printhead 50*b*, 50*c* inside container 10, the base 20 assumes, in this case, one or other of the two positions shown in FIGS. 3 and 4, depending on the command transmitted to it by positioning mechanism 30.

Positioning mechanism 30 (FIG. 2) comprises a lever with a plurality of arms 45, consisting of a central pipe 25 acting as a rotatable fulcrum with respect to an axis 26, whereto are attached the probe arm 24, a spring-holder arm 31, substantially aligned with probe arm 24, a first lever 27 and a second lever 28, generically at right angles with respect to probe arm 24 and parallel to each other. Probe arm 24 possesses one end 29, apt to come into contact with printhead 50*a* when inserted in container 10. The spring-holder arm 31, at the end opposite that by which it is fixed to pipe 25, is equipped with an eyelet 32, whereto return spring 23 is attached (not shown in the figure). The two levers 27, 28 each bear, at the end opposite that by which they are fixed to pipe 25, respectively a first pin 33 and a second pin 34.

Positioning mechanism 30 also comprises a balancer arm member 35, comprising a pair of arms 36, substantially parallel to each other and connected by a cross-piece 38 substantially perpendicular to both, and a shaft 39 around which it is free to rotate. Arms 36 are equipped with two forked ends 41 apt to engage with pins 33, 34, and are connected to each other in a central position by a shaft 37, substantially parallel to the axis of rotation 39 and to the cross-piece 38, which is rotatably coupled to internal sliding member 22 of support 20, whereto cap 15 is fitted.

Positioning mechanism 30 as a whole represents a system of linkages which transmits to cap 15 the motion of the end 29 of probe 24, when printhead 50*a* is inserted in container 10.

A flexible hose 42 is connected at one end to the hollow central area 40 of cap 15 and at the other to a serpentine passageway, not shown in the figure, achieved by means of a capillary tube in a bottom wall 8 of container 10, which in turn is in connection with the outside world, the purpose of this being to constitute a considerable obstacle to diffusion to the outside world of the atmosphere enclosed between the support face 52 of printhead 50*b* and internal rim 18 of cap 15, (or, correspondingly, between the support face 52 of printhead 50*c* and external rim 17), though permitting instantaneous adaptation of said atmosphere to variations in pressure of the outside world.

The mode of operation of this first, preferred embodiment of the storage apparatus according to the present invention will be described hereinafter, with reference to FIGS. 3 and 4.

Take the case where, after performing colour printing with an ink jet printer equipped with interchangeable printheads, the printer now has to be arranged for black printing; it will accordingly be necessary in succession to remove the printhead for colour printing 50*c* from the printhead carriage, remove the printhead for black printing 50*b* from the storage apparatus and insert it in the printhead carriage, and finally insert the printhead for colour printing 50*c* in container 10.

The two printheads 50*b* e 50*c*, as stated previously, differ, as in many other characteristics not relevant to the scope of this invention, in the fact that dimensions of the support face 52 bearing the ejector plate containing the nozzles 51 are greater for the colour printing printhead than for the black printing printhead.

The starting configuration of positioning mechanism 30 is that shown in FIG. 4, where probe arm 24 is at rest against stop 44 through the action of return spring 23, as there is no printhead inside container 10; when the printhead 50*c* for colour printing is inserted in container 10 (FIG. 3), end 29 of probe arm 24 will come into contact with support face 52 of printhead 50*c*, and probe arm 24 will be made rotate clockwise in the downward direction to contrast action of return spring 23. This produces rotation, also clockwise, of levers 27, 28 around axis 26, which, through the translation of pins 33, 34 into forks 41, causes the rotation of balancer 35 around shaft 39 and the consequent downward displacement of shaft 37, which in turn produces a corresponding downward displacement by a distance of length "d" of internal sliding member 22 with respect to external sliding member 21.

Accordingly, internal rim 18 first finds itself under external rim 17, and subsequently external rim 17 is brought first to rest against and then pressed lightly against support face 52, so that an efficacious seal is achieved.

Furthermore as the volume of air between cap 15 and printhead 50*c* is in communication with the outside through flexible hose 42, during the compression of external rim 17, no excess of pressure is created, which could push the ink away from the nozzles 51; similarly, in subsequent removal of printhead 50*c* from container 10, no depression is created, which could suck ink back from nozzles 51.

Starting from the situation just described, now take the case in which the inverse operation has to be performed, i.e. printhead 50*b* for black printing has to be removed from the printhead carriage of the ink jet printer with interchangeable printheads, printhead 50*c* for colour printing removed from the storage apparatus and inserted in the printhead carriage, and finally printhead 50*b* for black printing has to be inserted in container 10.

When the printhead 50*c* for colour printing is removed from the storage apparatus, the return spring 23 makes probe arm 24 rotate counter-clockwise in the upward direction around axis 26, until it comes against stop 44 (FIG. 4).

This results in rotation, again counter-clockwise, of levers 27, 28, which in turn, by the translation of pins 33, 34 into forks 41, cause balancer 35 to rotate around axis 39, with consequent upward displacement of shaft 37, thus making internal sliding member 22 slide upwards with respect to external sliding member 21 by a distance of length "d". Accordingly, internal rim 18 will be above external rim 17 and, on subsequent insertion of the printhead 50*b* for black printing, internal rim 18 comes first into contact with the zone of the support face 52 bearing the ejector plate containing nozzles 51 and then, with printhead 50*b* continuing its travel, is pressed lightly against support face 52, so that an efficacious seal is achieved.

Figure 5:
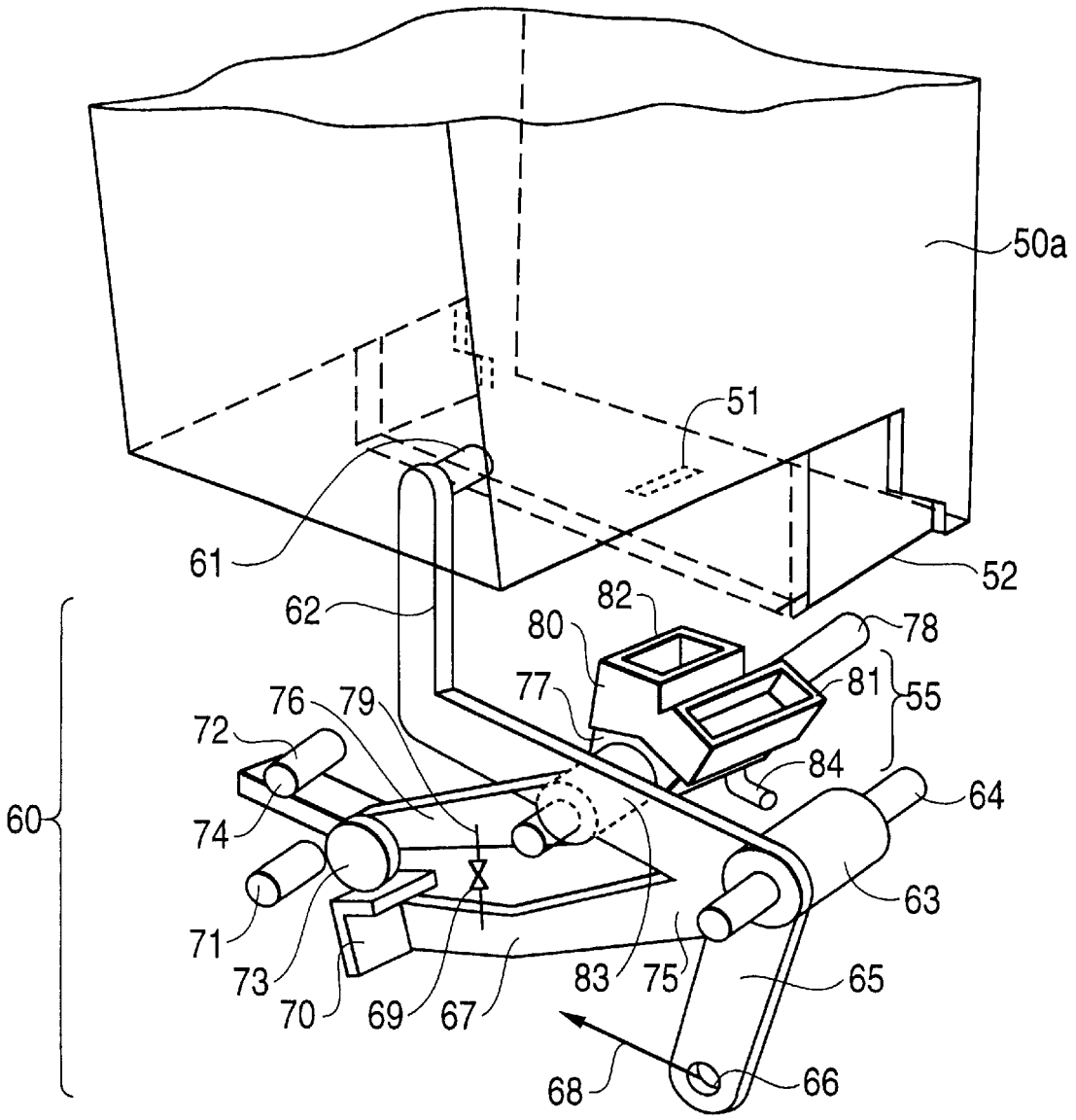
FIG. 5 is a perspective view of the positioning mechanism and of the capping system for sealing of the area of the printhead bearing the nozzles, according to a second, preferred embodiment.

According to a second version of the preferred embodiment of the storage apparatus according to the present invention, resident inside the base 11 of container 10 is a positioning mechanism 60 (FIG. 5) and a capping system 55 which, by means of a rotary motion imparted to it by positioning mechanism 60, selectively couples to support face 52 bearing the ejector plate containing the nozzles 51 of printhead 50*a*, to seal the nozzles 51 from the surrounding atmosphere.

Positioning mechanism 60 comprises a first lever 75 consisting of a central hose 63 acting as a rotatable fulcrum around a shaft 64, a crankarm 62, a spring-holder arm 65 substantially at right angles to the crankarm 62, and an arm 67 disposed in an intermediate position between crankarm 62 and spring-holder arm 65.

Crankarm 62 is equipped with a probe pin 61 fixedly attached at the end opposite that at which arm 62 is attached to the hose 63; the spring-holder arm 65 has an eyelet 66, at the end opposite that by which it is attached to hose 63, to which a return spring 68, not shown in the figure, is hooked. Finally arm 67 terminates, at the end opposite that by which it is attached to hose 63, in a support member 70.

Positioning mechanism 60 also comprises a second lever 76, consisting of a central hose 83 with the function of a rotatable fulcrum with respect to a shaft 78, an arm 79, and a V-shape support base, located substantially diametrically opposite arm 79 with respect to hose 83. Arm 79 is equipped in an intermediate position with a support end 73 which is kept in contact with support element 70 of lever 75 through the action of a tension spring 69, shown schematically in the figure as an arrow, hooked respectively to arm 79 and arm 67. Arm 79 terminates, at the end opposite that by which it is attached to hose 83, in a stop blade 74, movable between a first fixed stop 71 and a second fixed stop 72.

Figure 6:
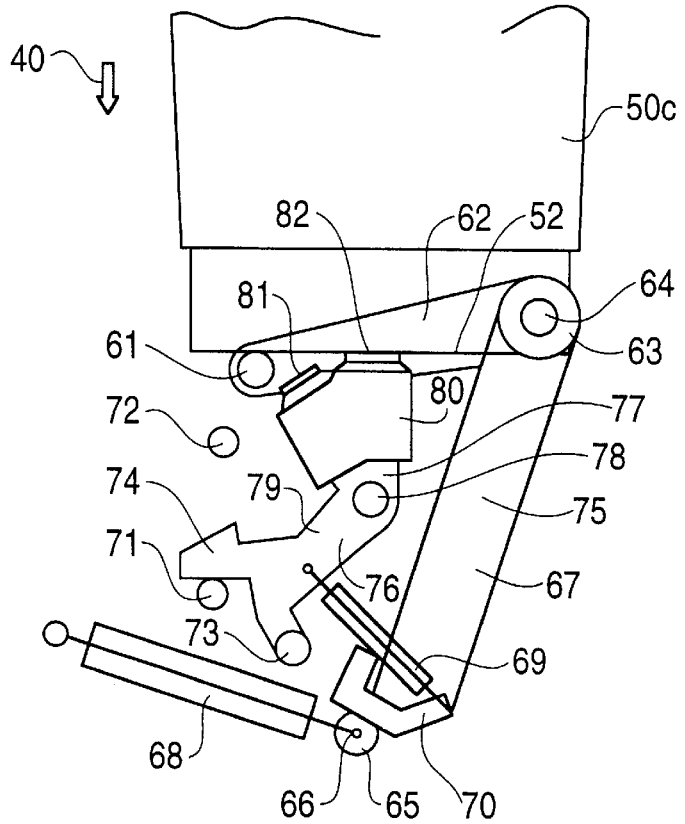
FIG. 6 is a side elevational view of the positioning mechanism and of the capping system for sealing of the area of the printhead bearing the nozzles, according to a second, preferred embodiment, in the event that the storage apparatus contains a printhead for colour printing.

The capping system 55 comprises a rubber cap 80, fitted on the two legs of the V-shape support base 77, which in turn comprises two, separate elastic rims, both approximately rectangular in shape but of different dimensions: a first rim 81 designed to seal printhead 50*b* for black printing (FIG. 7), and a second rim 82, designed to seal printhead 50*c* for colour printing (FIG. 6).

Figure 7:
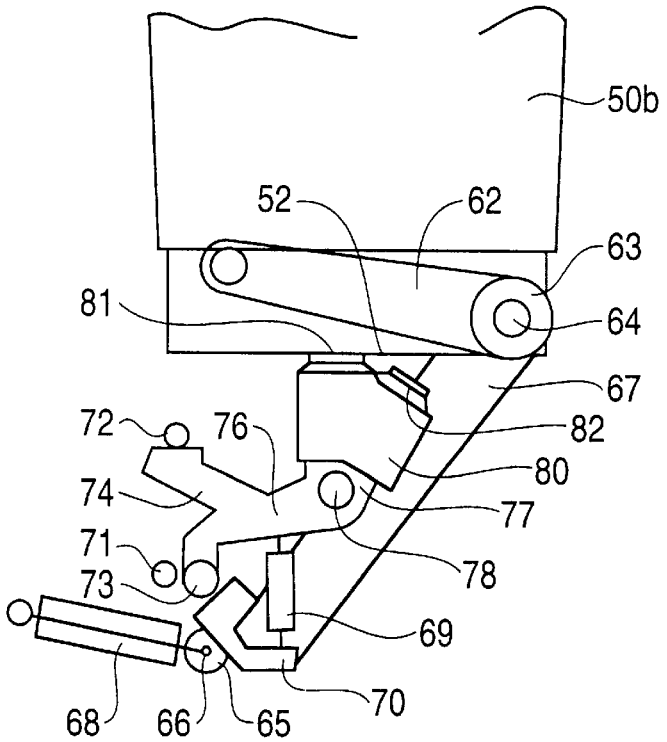
FIG. 7 is a side elevational view of the positioning mechanism and of the capping system for sealing of the area of the printhead bearing the nozzles, according to a second, preferred embodiment, in the event that the storage apparatus contains a printhead for black printing.

The support base 77, by way of rotation around shaft 78, may adopt two defined positions, shown respectively in FIGS. 6 and 7: the position of FIG. 6 is that adopted when printhead 50*c* for colour printing is inserted in container 10, while the position of FIG. 7 is that adopted when printhead 50*b* for black printing is inserted in container 10, or when there is no printhead therein.

When there is no printhead inside container 10, support base 77 adopts the position FIG. 7 through the action of return spring 68; on the other hand, when there is a printhead inside container 10, the support base 77 adopts one or other of the two positions shown in FIGS. 6 and 7, depending on the command transmitted to it by positioning mechanism 60, when probe pin 61 comes into contact with printhead 50*a* while the latter is being inserted in container 10 and levers 75, 76 command rotating motion of support base 77 around shaft 78.

Cap 80, on the side opposite elastic rims 81, 82, is equipped with a tube (not shown) which is attached to a flexible tube 84 (FIG. 5), with characteristics and functions identical to those described with reference to the first preferred embodiment of the storage apparatus in accordance with the present invention, which should be consulted for details.

The mode of operation of this second, preferred embodiment of the storage apparatus according to the present invention will be described hereinafter.

Take the case where, after performing colour printing with an ink jet printer equipped with interchangeable printheads, the printer now has to be arranged for black printing; it will accordingly be necessary in succession to remove the printhead for colour printing 50*c* from the printhead carriage, remove the printhead for black printing 50*b* from the storage apparatus and insert it in the printhead carriage, and finally insert the printhead for colour printing 50*c* in container 10.

Starting configuration of positioning mechanism 60 is that shown in FIG. 7, as there is no printhead in container 10, wherein stop blade 74 is at rest against second fixed stop 72 under the action of return spring 68 and of tension spring 69. When printhead 50*c* for colour printing is inserted in container 10, probe pin 61 will come into contact with support face 52 of printhead 50*c*, and will be pushed downwards in the direction of arrow 90 (FIG. 6), thereby transmitting to first lever 75 a counter-clockwise rotation around shaft 64 and putting return spring 68 under tension.

Through the action of tension spring 69, arm 79 of second lever 76 is also made rotate counter-clockwise around shaft 78, so that stop blade 74 detaches itself from contact with second fixed stop 72 and, continuing its rotation, comes to rest against first fixed stop 71.

Support base 77, also rotating in the counter-clockwise direction, brings second elastic rim 82 into contact with support face 52 bearing nozzles 51, so that an efficacious seal is achieved. Further, as the volume of air between cap 80 and printhead 50*c* is in communication with the outside through flexible tube 84, during the compression of external rim 82, no excess of pressure is created, which could push the ink away from the nozzles 51; similarly, in subsequent removal of printhead 50*c* from container 10, no depression is created, which could suck ink back from nozzles 51.

Starting from the situation just described, now take the case in which the inverse operation has to be performed, i.e. printhead 50*b* for black printing has to be removed from the printhead carriage of the ink jet printer with interchangeable printheads, printhead 50*c* for colour printing removed from the storage apparatus and inserted in the printhead carriage, and finally printhead 50*b* for black printing has to be inserted in container 10.

When printhead 50*c* for colour printing is removed from container 10, return spring 68 causes first lever 75 to rotate clockwise around shaft 64, so that support member 70 in its travel meets with support end 73 of second lever 77 and produces counter-clockwise rotation of arm 79, so that stop blade 74 first detaches itself from contact with first fixed stop 71 and then, continuing its rotation about 78, finally stops against second fixed stop 72. Support base 77, also rotating in the clockwise direction, brings first elastic rim 81 into the vertical position (FIG. 7). Accordingly, on subsequent insertion of printhead 50*b* for black printing in container 10, first elastic rim 81 comes first into contact with support face 52 bearing nozzles 51 and then, with printhead 50*b* continuing its travel, is pressed lightly against support face 52, so that an efficacious seal is achieved.

Both the first and the second version of the preferred embodiment of the storage apparatus in the above description have the advantage of requiring an amount of space only slightly superior to the volume occupied by the printhead and are thus suitable for inclusion inside the printer casing, thereby excluding the need for a dedicated container which, though small as it may be, still represents an extra cost and an irritating encumbrance for the printer user.

The fact also that the printheads, both the type for black printing and the type for colour printing, are inserted in the storage apparatus with the same orientation and in the same way as used for their insertion in the printhead carriage, and that, in both versions, the correct cap in function of the printhead inserted in the container is selected automatically, is a further simplification of operation considerably appreciated by users of the printer.

It will be apparent that modifications or changes may be made to single elements of the device of the present invention described in the foregoing, without departing from the scope of the present invention.

What is claimed is:

1. A storage apparatus for ink jet print heads of at least a first type and a second type, said print heads having a support face bearing nozzles for discharging ink droplets and apt to be fitted interchangeably with an orientation in a device for generating images on a medium; said apparatus comprising:

capping means apt for coupling to said support face for isolating and protecting said nozzles said capping means comprising an outside wall which terminates in an external elastic rim, and an inside wall which terminates in an internal elastic rim, said outside and inside walls being approximately rectangular in shape and concentrically arranged around a hollow central area, said internal and external rims defining an area which surrounds respectively said nozzles of said print head of at least a first type and said nozzles of said print head of a second type;

a support member comprising concentrically disposed sliding external member and sliding internal member, said outside wall being in contact with and bound to said external member, and said inside wall being in contact with and bound to said internal member; and positioning means for selectively positioning of said capping means, wherein said positioning means are selectively actuated by said first type and by said second type of print head to translate said sliding internal member and said sliding external member over a distance, whereby said internal elastic rim and said external elastic rim are selectively brought into coupling contact with said print head of at least a first type and said print head of a second type.

2. A storage apparatus according to claim 1, further comprising containing means having an aperture for insertion of said print head of at least a first type and of said print head of a second type, wherein said insertion automatically determines said selective coupling contact.

3. A storage apparatus according to claim 2, wherein said aperture is unique and wherein said insertion occurs with the said orientation for said print head of at least a first type and for said print head of a second type.

4. A storage apparatus according to claim 1, further comprising retention means of the said printheads, wherein said retention means provide a tactile and auditory sensation on correct insertion of said printheads in said storage apparatus.

5. A storage apparatus according to claim 1, wherein said capping means are in connection with the outside atmosphere by means of a pipe of capillary section of considerable length, arranged according to a serpentine path.

6. A storage apparatus according to claim 1, wherein said ink jet print head of at least a first type and said print head of a second type belong to a group consisting of monobloc disposable heads, refillable heads, heads containing a monochromatic ink, heads containing three coloured inks, and heads containing three coloured inks and a black ink.

7. A storage apparatus according to claim 1, wherein said print head of at least a first type is a print head for black printing and said print head of a second type is a print head for colour printing.

8. A storage apparatus for ink jet print heads of at least a first type and a second type, said print heads having a support face bearing nozzles for discharging ink droplets and apt to be fitted interchangeably with a direction in a device for generating images on a medium; comprising capping means apt for coupling to said support face for isolating and protecting said nozzles, wherein said capping means comprise a first and a second sealing member, respectively attached to the end of a first arm and to the end of a second arm of a V-shape support, and wherein said first and said second sealing member are brought selectively into coupling contact with said first type and with said second type of print head by means of a rotation about the relative apex of said V-shape support.

9. A storage apparatus according to claim 8, further comprising containing means having an aperture for insertion of said first type and of said second type of print head, wherein said insertion automatically determines said selective coupling.

10. A storage apparatus according to claim 9, wherein said aperture is unique and that said insertion occurs with said orientation for said first type and for said second type of print head.

11. A storage apparatus according to claim 8, wherein said capping means are in connection with the outside atmosphere by means of a pipe of capillary section of considerable length, arranged according to a serpentine path.

12. A storage apparatus according to claim 8, wherein said first type of print head is a print head for black printing and said second type of print head is a print head for colour printing.

13. A method for storage of ink jet print heads of at least a first type and a second type, said print heads having a support face bearing nozzles for discharging ink droplets and apt to be fitted interchangeably in a device for generating images on a medium; said method comprising the phases of:

disposing of a storage apparatus comprising capping means having an outside wall which terminates in an external elastic rim, and an inside wall which terminates in an internal elastic rim, said outside and inside walls being approximately rectangular in shape and concentrically arranged around a hollow central area, said internal and external rims defining an area which surrounds respectively said nozzles of said print head of at least a first type and said nozzles of said print head of a second type; a support member comprising concentrically disposed sliding external member and sliding internal member, said outside wall being in contact with and bound to said external member, and said inside wall being in contact with and bound to said internal member; and positioning means for selectively positioning of said capping means, wherein said positioning means are selectively actuated by said first type and by said second type of print head to slide said sliding internal member and said sliding external member over a distance, whereby said internal elastic rim and said external elastic rim are selectively brought into coupling contact with said print head of at least a first type and said print head of a second type;

inserting that print head of said first type and said second type, whichever of the two is not fitted in said device for generating images on a medium, in said storage apparatus, so as to isolate and protect said nozzles of said print head.

* * * * *